US012442542B2

(12) United States Patent
Li et al.

(10) Patent No.: US 12,442,542 B2
(45) Date of Patent: Oct. 14, 2025

(54) INDOOR UNIT OF AIR CONDITIONER, AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Baohua Li, Guangdong (CN); Weidong Zhang, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 259 days.

(21) Appl. No.: 18/139,499

(22) Filed: Apr. 26, 2023

(65) Prior Publication Data

US 2023/0258341 A1 Aug. 17, 2023

Related U.S. Application Data

(63) Continuation of application No. PCT/CN2021/091744, filed on Apr. 30, 2021.

(30) Foreign Application Priority Data

Dec. 31, 2020 (CN) ..... 202011634413.7
Dec. 31, 2020 (CN) ..... 202023310652.5

(51) Int. Cl.
*F24F 1/0007* (2019.01)
*F24F 1/0035* (2019.01)
(Continued)

(52) U.S. Cl.
CPC ..... *F24F 1/0007* (2013.01); *F24F 13/10* (2013.01); *F24F 1/0035* (2019.02); *F24F 1/0071* (2019.02)

(58) Field of Classification Search
CPC ..... F24F 1/0007; F24F 1/0057; F24F 13/10
See application file for complete search history.

(56) References Cited

U.S. PATENT DOCUMENTS 6,338,382 B1 * 1/2002 Takahashi ..... F24F 8/192 62/317
7,694,526 B2 * 4/2010 Inoue ..... F24F 13/30 62/426

(Continued)

FOREIGN PATENT DOCUMENTS

CN 105299754 A 2/2016
CN 109780632 A 5/2019

(Continued)

OTHER PUBLICATIONS

Translated_Wang (Year: 2020).*

(Continued)

*Primary Examiner* — Jerry-Daryl Fletcher
*Assistant Examiner* — Samba Nmn Gaye
(74) *Attorney, Agent, or Firm* — Scully, Scott, Murphy & Presser, P.C.

(57) ABSTRACT

An indoor unit of an air conditioner and an air conditioner are disclosed. The indoor unit has a housing and an evaporator. The housing has a first air duct, a second air duct, a first air intake port, a first air supply port, a second air intake port, and an adapter air duct assembly. The first air duct communicates with the first air intake port and the first air supply port. The second air duct communicates with the second air intake port and the adapter air duct assembly. In a first state, the adapter air duct assembly takes in and guides air from the second air duct to a preset air outlet position. In a second state, part of indoor return air from the first air intake port can pass through the adapter air duct assembly.

14 Claims, 7 Drawing Sheets

(51) Int. Cl.
*F24F 1/0071* (2019.01)
*F24F 13/10* (2006.01)

(56) References Cited

U.S. PATENT DOCUMENTS

| | | | | |
|---|---|---|---|---|
| 2006/0042778 | A1* | 3/2006 | Stevenson | B60H 1/00835 165/41 |
| 2007/0079619 | A1* | 4/2007 | Hamada | F24F 1/0083 62/186 |
| 2019/0101298 | A1* | 4/2019 | Adams | F24F 13/10 |

FOREIGN PATENT DOCUMENTS

| | | | | |
|---|---|---|---|---|
| CN | 109780633 | A | | 5/2019 |
| CN | 109883031 | A | * | 6/2019 |
| CN | 208936412 | U | | 6/2019 |
| CN | 209181105 | U | | 7/2019 |
| CN | 209763304 | U | * | 12/2019 |
| CN | 110657492 | A | | 1/2020 |
| CN | 110986173 | A | * | 4/2020 |
| CN | 211177121 | U | * | 8/2020 |
| CN | 211575299 | U | | 9/2020 |
| CN | 111853942 | A | | 10/2020 |
| JP | 2002089923 | A | | 3/2002 |
| WO | 2017049540 | A1 | | 3/2017 |

OTHER PUBLICATIONS

Translated_Dong (Year: 2020).*
Translated_Peng (Year: 2019).*
Translated_Chen (Year: 2019).*
Supplementary European Search Report dated Mar. 19, 2024 received in European Patent Application No. EP 21912806.3.
International Search Report dated Sep. 28, 2021 issued in PCT/CN2021/091744.
Written Opinion dated Sep. 28, 2021 issued in PCT/CN2021/091744.

* cited by examiner

INDOOR UNIT OF AIR CONDITIONER, AND AIR CONDITIONER

CROSS-REFERENCE TO RELATED APPLICATIONS

This application is a continuation application of International Application No. PCT/CN2021/091744, filed on Apr. 30, 2021, which claims priority to and benefits of Chinese patent application No. 202011634413.7 filed on Dec. 31, 2020 and Chinese patent application No. 202023310652.5 filed on Dec. 31, 2020, the entire contents of each of which are incorporated herein by reference for all purposes. No new matter has been introduced.

FIELD

The present disclosure relates to the field of air conditioning, and in particular to an indoor unit of an air conditioner and an air conditioner.

BACKGROUND

In the related technology, an indoor unit of an air conditioner is equipped with a fresh air duct, and fresh air is introduced into a primary air duct through the fresh air duct, subjected to heat exchange through an evaporator, and then output through an air supply port of the primary air duct. In this way, the difference between the temperature of the output fresh air and the room temperature is slight, which improves user experience. However, in this scheme, the fresh air duct affects the air volume of the primary air duct, thus decreasing the air heat exchange efficiency of the primary air duct during cooling and heating.

SUMMARY

Embodiments of the present disclosure provide an indoor unit of an air conditioner and an air conditioner which have less influence on the heat exchange efficiency of a heat exchanger.

In order to achieve at least the above objective, an embodiment of the present disclosure provides an indoor unit of an air conditioner. The indoor unit includes a housing and an evaporator. The housing is provided with a first air duct, a second air duct, a first air intake port, a first air supply port, a second air intake port and an adapter air duct assembly. The first air duct communicates with the first air intake port and the first air supply port. The second air duct communicates with the second air intake port and the adapter air duct assembly. The evaporator is arranged in the first air duct, and the adapter air duct assembly is arranged in the first air duct and located at an air inlet side of the evaporator. The adapter air duct assembly has a first state and a second state. In the first state, the adapter air duct assembly takes in air from the second air duct and guides the airflow of the second air duct to a preset air outlet position. In the second state, part of indoor return air from the first air intake port is able to pass through the adapter air duct assembly.

In some implementations, a side, facing the evaporator, of the adapter air duct assembly is provided with a first air outlet. The airflow in the adapter air duct assembly is dischargeable from the first air outlet and flow to the evaporator.

In some implementations, the housing is provided with a second air supply port, and the adapter air duct assembly is provided with a second air outlet communicating with the second air supply port. In the first state, the adapter air duct assembly is able to selectively discharge the airflow from the second air duct through the first air outlet or the second air outlet.

In some implementations, a side, close to the first air intake port, of the adapter air duct assembly is provided with a first air inlet. The first air inlet and the first air outlet are located on a flow path of the indoor return air from the first air intake port.

In some implementations, the indoor unit of the air conditioner has a first mode, a second mode and a third mode.

In the first mode, the first air outlet is open, the second air outlet and the first air inlet are both closed, and the airflow from the second air duct flows to the evaporator through the first air outlet and is output through the first air supply port.

In the second mode, the second air outlet is open, the first air outlet and the first air inlet are both closed, and the airflow from the second air duct flows to the second air supply port through the second air outlet and is output through the second air supply port.

In the third mode, the second air outlet is closed, the first air outlet and the first air inlet are both open, and the indoor return air from the first air inlet enters the adapter air duct assembly through the first air inlet and flows to a heat exchanger through the first air outlet.

In some implementations, the indoor unit includes an air supply mechanism arranged in the second air duct, and in the third mode, the air supply mechanism is in a non-working state, and a resistance of air taken in by the adapter air duct assembly from the second air duct is greater than that from the first air intake port.

In some implementations, the indoor unit includes an air supply mechanism arranged in the second air duct, and the indoor unit has a fourth mode. In the fourth mode, the second air outlet is closed, the first air outlet and the first air inlet are both open, the air supply mechanism is in a working state, and a resistance of air taken in by the adapter air duct assembly from the second air duct is smaller than that from the first air intake port.

In some implementations, the adapter air duct assembly includes an air duct body and a valve assembly movably arranged on the air duct body. The first air duct and the second air duct are arranged along a length direction of the housing, and the air duct body extends along the length direction of the housing. A rear side of the air duct body is provided with the first air outlet, a top side of the air duct body is provided with the first air inlet, a front side of the air duct body is provided with a second air outlet. The second air outlet is aligned with the second air supply port to discharge air. The valve assembly is able to move relative to the air duct body to selectively close the first air inlet, the first air outlet or the second air outlet.

In some implementations, the air duct body includes a top frame plate, a first frame plate abutting against the evaporator, and a second frame plate arranged at a front side of the first frame plate. A lower end of the first frame plate is connected to a lower end of the second frame plate. The valve assembly includes a first valve plate and a second valve plate. A lower end of the first valve plate is rotatably connected at a joint between the first frame plate and the second frame plate. The first valve plate can be selectively arranged on an inner surface of the first frame plate or an inner surface of the second frame plate in an overlaying manner. The second valve plate is arranged at the first air inlet to selectively open or close the first air inlet.

In some implementations, a front end of the second valve plate is rotatably connected to the air duct body. The second valve plate is able to rotate to abut against the inner surface of the second frame plate and open the first air inlet.

In some implementations, the second air intake port is a fresh air inlet. Alternatively, the second air intake port is an indoor purification air return port.

In some implementations, the number of the second air intake ports is more than one. At least one of the second air intake ports is a fresh air inlet. At least one of the remaining second air intake ports is an indoor purification air return port. The second air duct is able to selectively take in air from the fresh air inlet and/or the indoor purification air return port.

In some implementations, the housing includes a base plate, a face frame assembly and a front panel. The base plate and the face frame assembly are in snap-fit connection. The first air intake port is arranged at a top side of the face frame assembly. The adapter air duct assembly is arranged between a front side of the evaporator and a rear side of the face frame assembly. In the second state, part of the indoor return air from the first air intake port passes through the adapter air duct assembly from top to bottom of the adapter air duct assembly.

In some implementations, the evaporator includes a rear evaporator body, a middle evaporator body and a front evaporator body, which are sequentially connected, and the middle evaporator body is arranged along the indoor unit from rear to front in a downward inclination manner. The adapter air duct assembly abuts against a front side of the middle evaporator body. Indoor return air passing through the adapter air duct assembly is able to flow to the middle evaporator body and the front evaporator body.

In some implementations, two opposite ends of the evaporator in a length direction are provided with refrigerant pipe ends. The adapter air duct assembly is detachably connected to the refrigerant pipe ends.

In some implementations, a side, facing the evaporator, of the adapter air duct assembly is provided with an elastic snap fastener. The elastic snap fastener is provided with a recess and an opening which communicate with each other. The opening is restorably expanded by the refrigerant pipe end when the refrigerant pipe end fits into the recess.

An embodiment of the present disclosure provides an air conditioner including an outdoor unit and any one of the indoor units described above. The outdoor unit and the indoor unit are connected through a refrigerant pipe.

For the indoor unit according to the embodiments of the present disclosure, the airflow in the second air duct can be outdoor fresh air, indoor purified airflow, etc. When a user needs the functions of purification, fresh air, etc., the adapter air duct assembly can be set in the first state, such that the airflow from the second air duct flows indoors; and when the user needs to cool or heat the room, the adapter air duct assembly can be set in the second state, such that the indoor return air exchanges heat with the evaporator in the process of flowing through the first air duct and is output through the first air supply port. Because part of the indoor return air from the first air intake port can pass through the adapter air duct assembly, the adapter air duct assembly will not block the indoor return air from flowing to the evaporator, so the adapter air duct assembly hardly affects a contact area between the evaporator and the indoor return air, and the heat exchange efficiency of the evaporator is hardly affected.

DETAILED DESCRIPTION OF EMBODIMENTS

Figure 1:
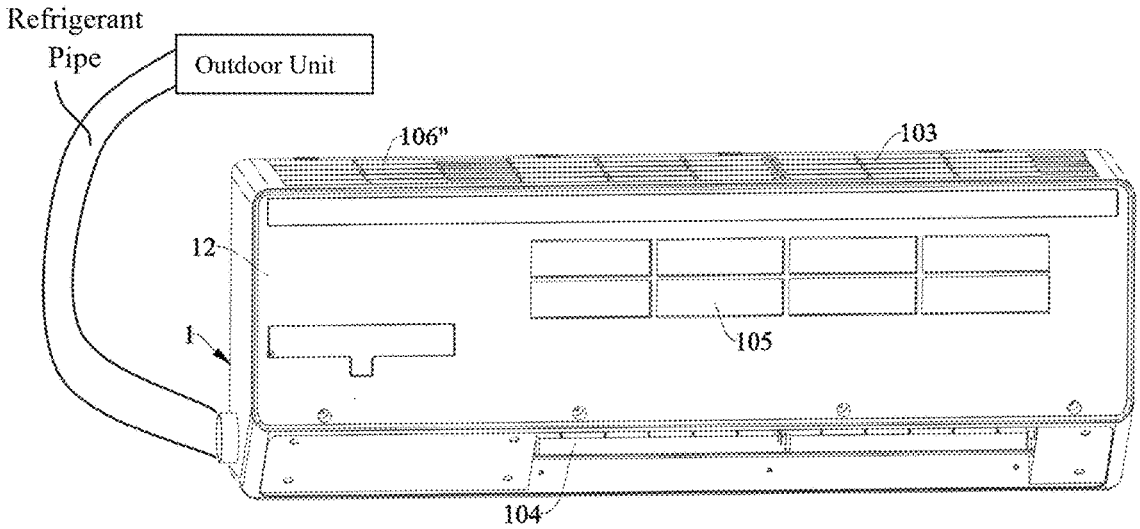
FIG. 1 is a schematic diagram of an indoor unit of an air conditioner according to an embodiment of the present disclosure, in which a front panel is omitted.

It should be noted that, the embodiments in the present disclosure and the technical features in the embodiments can be combined with each other without conflict, and the detailed description should be understood as an explanation of the present disclosure and should not be regarded as an undue restriction on the present disclosure.

In the description of the embodiments of the present disclosure, the orientation or positional relationships indicated by terms like "upper", "lower", "left", "right", "front", "rear" and "length direction" are based on the orientation or positional relationships shown in the drawings. It should be understood that these positional terms are merely for convenience of description of the present disclosure and simplification of description, and do not indicate or imply that the indicated devices or elements must have a specific orientation, be constructed and operate in a specific orientation, and therefore cannot be understood as limitations to the present disclosure.

An indoor unit of an air conditioner, as shown in FIGS. 1, 2, 3 and 5-8, includes a housing 1 and an evaporator 3, the housing 1 is provided with a first air duct 101, a second air duct, a first air intake port 103, a first air supply port 104, a second air intake port and an adapter air duct assembly 14. The first air duct 101 communicates with the first air intake port 103 and the first air supply port 104. The second air duct communicates with the second air intake port and the adapter air duct assembly 14, that is, the second air duct outputs air through the adapter air duct assembly 14.

Referring to FIGS. 5-8, the evaporator 3 is arranged in the first air duct 101. The evaporator 3 exchanges heat on the airflow in the first air duct 101. In a cooling mode, the evaporator 3 outputs cold air through the first air supply port 104, while in a heating mode, the evaporator 3 outputs hot air through the first air supply port 104. It can be understood that the evaporator 3 may only have a cooling function, or may only have a heating function, or may have both a heating function and a cooling function, so users can choose the heating function or the cooling function as needed.

The adapter air duct assembly 14 is arranged in the first air duct 101 and located at an air inlet side of the evaporator 3. The adapter air duct assembly 14 has a first state and a second state. In the first state, referring to FIGS. 5 and 6, the adapter air duct assembly 14 is constructed as an air guide structure, and the adapter air duct assembly 14 takes in air from the second air duct and guides the airflow of the second air duct to a preset air outlet position. In the second state, referring to FIG. 7, the adapter air duct assembly 14 is constructed as a ventilation structure, and part of indoor return air from the first air intake port 103 can pass through the adapter air duct assembly 14.

For the indoor unit according to the embodiments of the present disclosure, the airflow in the second air duct can be outdoor fresh air, indoor purified airflow, etc. When a user needs the functions of purification, fresh air, etc., the adapter air duct assembly 14 can be set in the first state, such that the airflow from the second air duct flows indoors. When the user needs to cool or heat the room, the adapter air duct assembly 14 can be set in the second state, such that the indoor return air exchanges heat with the evaporator 3 in the process of flowing through the first air duct 101 and is output through the first air supply port 104. For example, the first air duct 101 is a primary air duct for the indoor unit to realize the cooling and heating functions. Because part of the indoor return air from the first air intake port 103 can pass through the adapter air duct assembly 14, the adapter air duct assembly 14 will not block the indoor return air from flowing to the evaporator 3, so the adapter air duct assembly 14 hardly affects a contact area between the evaporator 3 and the indoor return air, and the heat exchange efficiency of the evaporator 3 is hardly affected.

It can be understood that the indoor unit is equipped with a wind wheel 2 and an air supply mechanism. The wind wheel 2 is arranged in the first air duct 101 to drive the air in the first air duct 101 to flow in a specific direction, and the evaporator 3 is arranged at an air inlet side of the wind wheel 2. The air supply mechanism is arranged in the second air duct to drive the air in the second air duct to flow in a specific direction.

It should be noted that the airflow entering the second air duct from the second air intake port can be outdoor fresh air, indoor return air, or mixed airflow of indoor return air and outdoor fresh air.

In an embodiment, the second air intake port is a fresh air inlet 106', that is, the airflow entering the second air duct from the second air intake port is outdoor fresh air. In another embodiment, the second air intake port is an indoor purification air return port 106", that is, the airflow entering the second air duct from the second air intake port is indoor return air. In some embodiments, referring to FIG. 2, there are a plurality of second air intake ports, at least one second air intake port is a fresh air inlet 106', and at least another one of the second air intake ports is an indoor purification air return port 106". The second air duct can selectively take in air from the fresh air inlet 106' and/or the indoor purification air return port 106". Here, the second air duct selectively taking in air from the fresh air inlet 106' and/or the indoor purification air return port 106" includes the following three situations. In a first situation, the second air duct only introduces outdoor fresh air from the fresh air inlet 106'. In a second situation, the second air duct only introduces indoor return air from the indoor purification air return port 106". In a third situation, the second air duct takes in air from the fresh air inlet 106' and the indoor purification air return port 106" at the same time, and thus the airflow in the second air duct is mixed airflow of outdoor fresh air and indoor return air. In other words, in this situation, outdoor fresh air and indoor purified air share the same second air duct, which can save space and make the structure of the indoor unit compact.

In the embodiment where both the indoor purification air return port 106" and the fresh air inlet 106' are provided, the indoor unit may further include a first switch door arranged at the fresh air inlet 106' and a second switch door arranged at the indoor purification air return port 106". The first switch door selectively opens or closes the fresh air inlet 106', and the second switch door selectively opens or closes the indoor purification air return port 106". When the second air duct only needs to introduce outdoor fresh air, the first switch door opens the fresh air inlet 106' and the second switch door closes the indoor purification air return port 106". When the second air duct only needs to introduce indoor return air, the first switch door closes the fresh air inlet 106' and the second switch door opens the indoor purification air return port 106". When the second air duct needs to take in outdoor fresh air and indoor return air in proportion, the first switch door opens the fresh air inlet 106' and the second switch door opens the indoor purification air return port 106".

Figure 2:
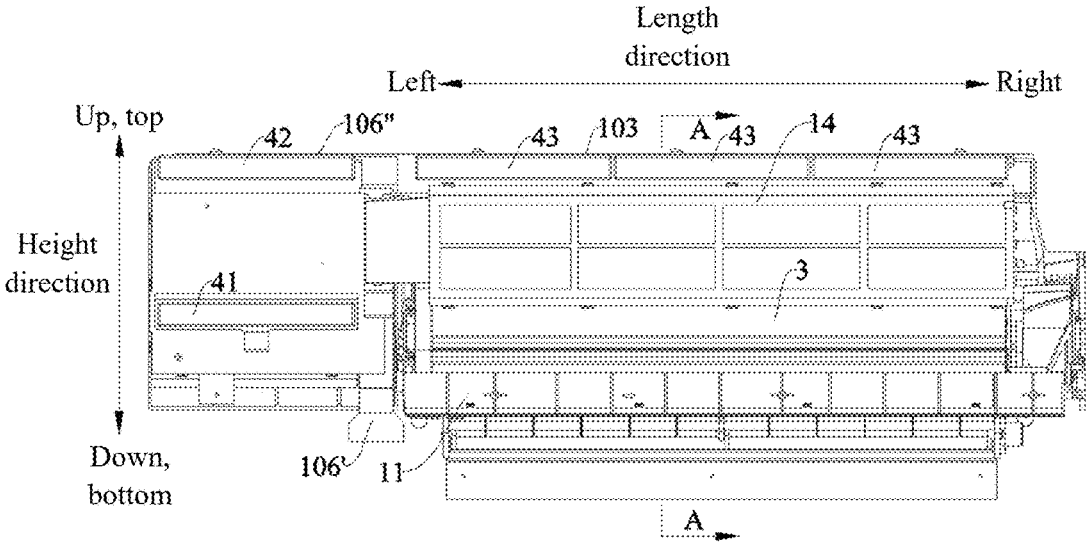
FIG. 2 is a schematic diagram of the structure shown in FIG. 1 from another perspective.
Figure 3:
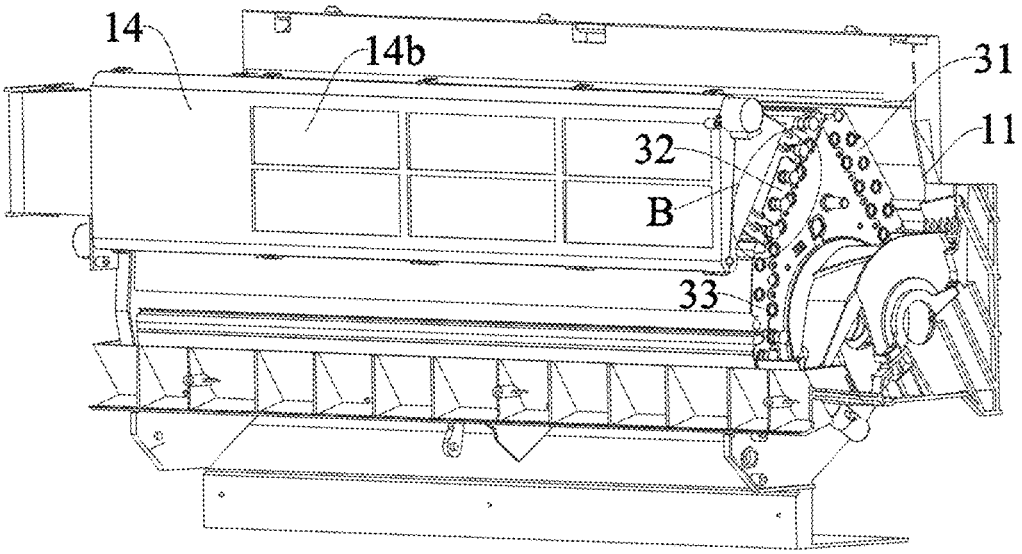
FIG. 3 is a schematic diagram of the structure shown in FIG. 1 from yet another perspective.

In some embodiments, referring to FIG. 2, a first filter screen module 42 is arranged at the fresh air inlet 106' to block impurities, such as, pollen and dust carried in outdoor fresh air. It should be noted that the air resistance in the first filter screen module 42 is low, so as not to block outdoor fresh air.

In some embodiments, referring to FIG. 2, a first purification module 41 is arranged at the indoor purification air return port 106", and the first purification module 41 sterilizes the indoor return air flowing through the indoor purification air return port 106". The type of the first purification module 41 is not limited, and one or more filter screens with sterilization and disinfection functions for certain specific pollutants can be provided according to actual use scenarios. For example, the first purification module 41 includes a dust removal screen, a formaldehyde filter screen and a plasma screen, which are sequentially arranged in an airflow direction. The specific material of the dust removal screen is not limited, as long as a basic dust removal effect can be realized. The formaldehyde filter screen not only can efficiently absorb formaldehyde, but also can filter out other volatile organic compounds, allergens and bacteria. The plasma screen sterilizes and disinfects the airflow through ion emission. For another example, the first purification module 41 is an HEPA (High Efficiency Particulate Air) filter.

In some embodiments, referring to FIGS. 5-8, a second filter screen module 43 is arranged at the first air intake port 103. The second filter screen module 43 filters the indoor return air to reduce the probability of impurities, such as, dust entering the first air duct 101. It should be noted that the second filter screen module 43 can also be a low-air resistance filter screen, so as not to block the air introduced by the first air duct 101.

It should be noted that in the first state, the adapter air duct assembly 14 can guide the airflow of the second air duct to any suitable air outlet position. For example, the adapter air duct assembly 14 can directly guide the airflow of the second air duct to the outside of the housing 1, that is, the airflow of the second air duct will not exchange heat with the evaporator 3. For another example, the adapter air duct assembly 14 can guide the airflow of the second air duct into the first air duct 101 and supply air through the first air supply port 104.

In some embodiments, referring to FIGS. 5-8, a side, facing the evaporator 3, of the adapter air duct assembly 14 is provided with a first air outlet 14*a*. The airflow in the adapter air duct assembly 14 can be discharged from the first air outlet 14*a* and flow to the evaporator 3. The airflow in the adapter air duct assembly 14 can be discharged from the first air outlet 14*a* and flow to the evaporator 3 in the following two ways. In a first way, when the adapter air duct assembly 14 takes in air from the first air intake port 103, the indoor return air entering the adapter air duct assembly 14 passes through the adapter air duct assembly 14 from the first air outlet 14*a* and flows to the evaporator 3. In a second way, when the adapter air duct assembly 14 takes in air from the second air duct, the airflow from the second air duct is discharged through the first air outlet 14*a* and flows to the evaporator 3.

In this embodiment, the preset air outlet position includes the first air outlet 14*a*. The first air duct 101 and the second air duct can supply air through the first air supply port 104. The airflow from the second air duct flows through the evaporator 3 and is supplied through the first air supply port 104, such that the output airflow can be close to room temperature and user experience can be improved.

For example, a plasma module can be arranged in the second air duct. The plasma emitted by the plasma module can enter the first air duct 101 with the airflow, thus realizing the sterilization and disinfection of the first air duct 101.

Figure 5:
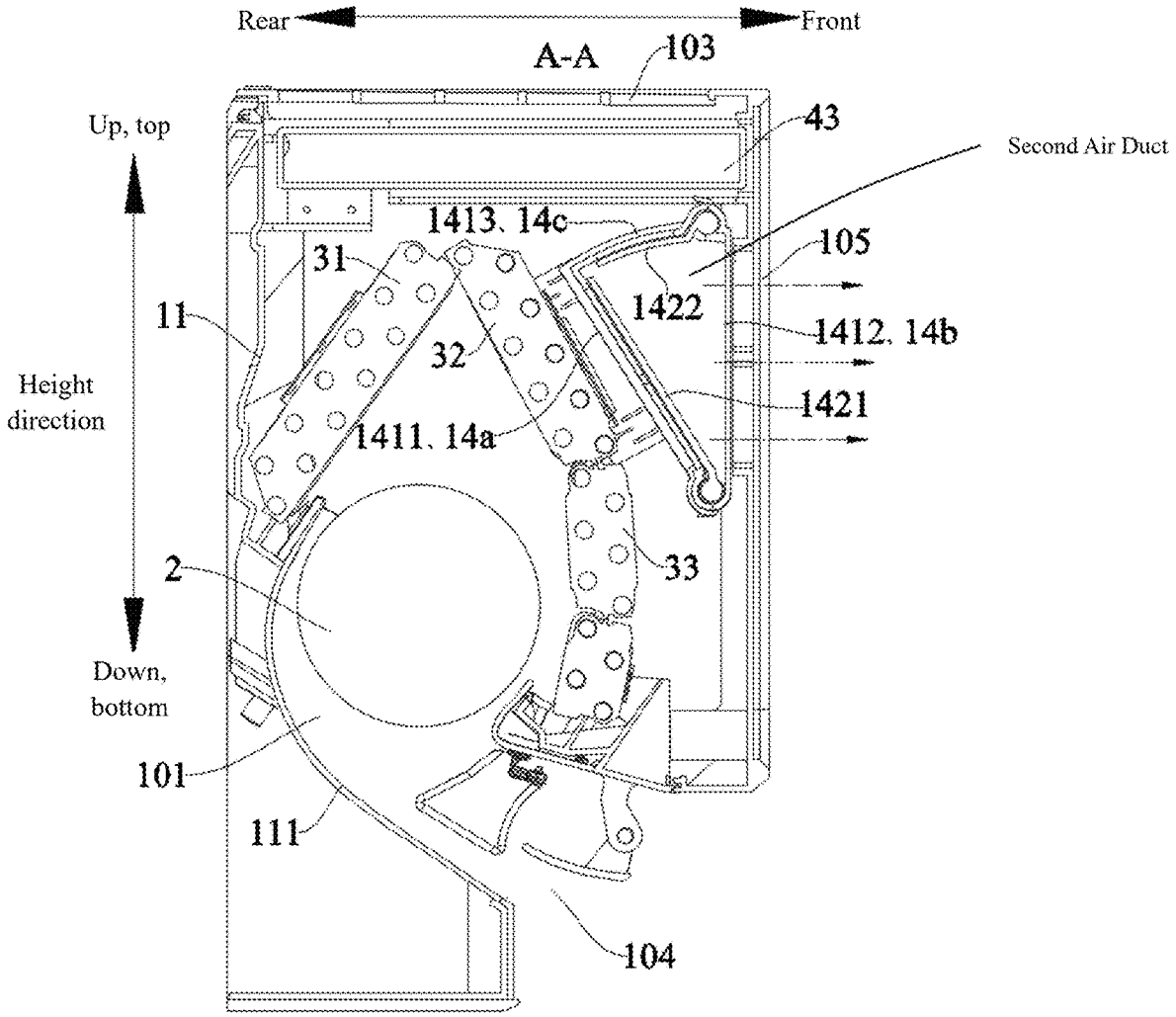
FIG. 5 is a sectional view taken along line A-A in FIG. 2, in which a second air outlet is open, a first air outlet and a first air inlet are closed, and arrows and dotted lines indicate the flow path of the airflow.
Figure 6:
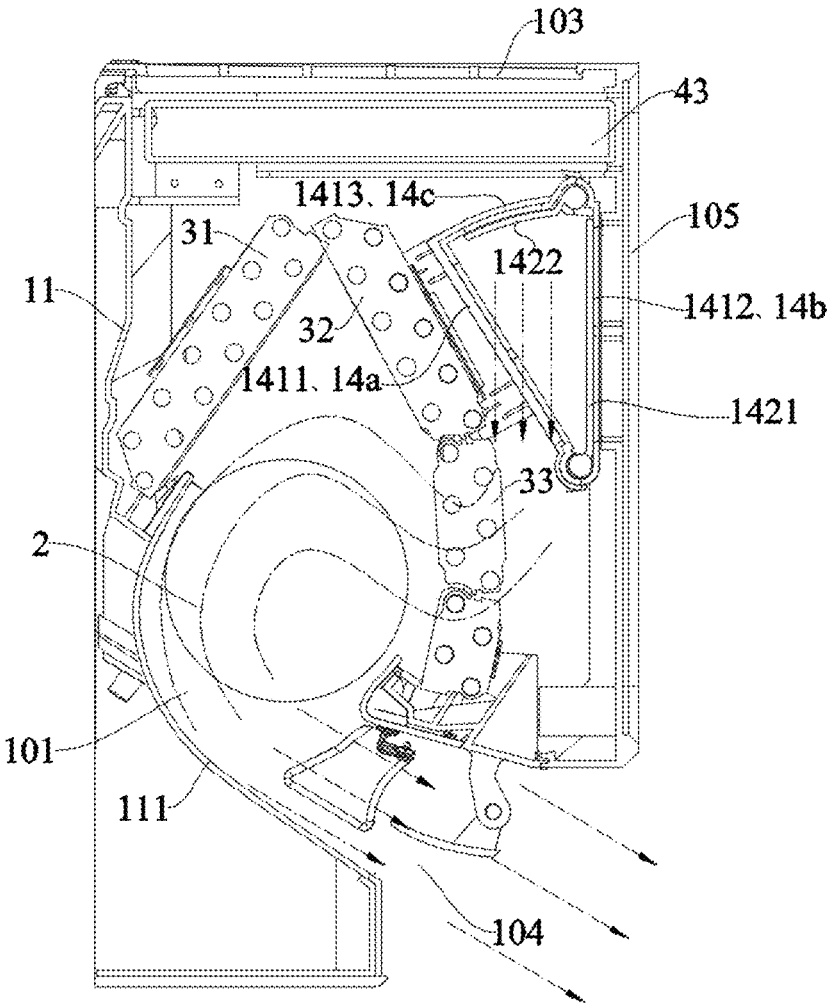
FIG. 6 is a schematic diagram of the structure shown in FIG. 5 in another state, in which a first air outlet is open, a second air outlet and a first air inlet are closed, and arrows and dotted lines indicate the flow path of the airflow.

In some embodiments, the housing 1 is provided with a second air supply port 105, and the adapter air duct assembly 14 is provided with a second air outlet 14*b* communicating with the second air supply port 105. In the first state, the adapter air duct assembly 14 is able to selectively discharge the airflow from the second air duct through the first air outlet 14*a* or the second air outlet 14*b*. That is, when the adapter air duct assembly 14 is in the first state, the adapter air duct assembly 14 has two preset air outlet positions, one is the first air outlet 14*a* and the other is the second air outlet 14*b*, such that the indoor unit has two air outlet modes. Referring to FIG. 6, when the adapter air duct assembly 14 discharges the airflow of the second air duct through the first air outlet 14*a*, the airflow from the second air duct will flow to the evaporator 3 through the first air outlet 14*a* and be output through the first air supply port 104. In this case, the temperature of the output airflow is close to room temperature. Referring to FIG. 5, when the adapter air duct assembly 14 discharges the airflow of the second air duct through the second air outlet 14*b*, the airflow from the second air duct will be output through the second air outlet 14*b* and the second air supply port 105 in sequence. In this case, the output airflow will not flow through the evaporator 3 and will not affect the indoor air temperature.

In some embodiments, a first air inlet 14*c* is arranged at a side, close to the first air intake port 103, of the adapter air duct assembly 14. A second air inlet 14*d* is arranged at an end, close to the second air duct, of the adapter air duct assembly 14. The second air inlet 14*d* is connected to an end of the second air duct. The first air inlet 14*c* and the first air outlet 14*a* are located on a flow path of indoor return air from the first air intake port 103. That is, when the adapter air duct assembly 14 is in the second state, the indoor return air can almost pass through the adapter air duct assembly 14 along an original path, such that the influence on the flow performance of the indoor return air is minimized.

For example, the indoor unit has a first mode, a second mode and a third mode.

In the first mode, referring to FIG. 6, the first air outlet 14*a* is open, and the second air outlet 14*b* and the first air inlet 14*c* are closed. In this mode, the adapter air duct assembly 14 is in the first state, and the airflow from the second air duct flows to the evaporator 3 through the first air outlet 14*a* and is output through the first air supply port 104.

In the second mode, referring to FIG. 5, the second air outlet 14*b* is open, and the first air outlet 14*a* and the first air inlet 14*c* are closed. In this mode, the adapter air duct assembly 14 is in the first state, and the airflow from the second air duct flows to the second air supply port 105 through the second air outlet 14*b* and is output through the second air supply port 105.

Figure 7:
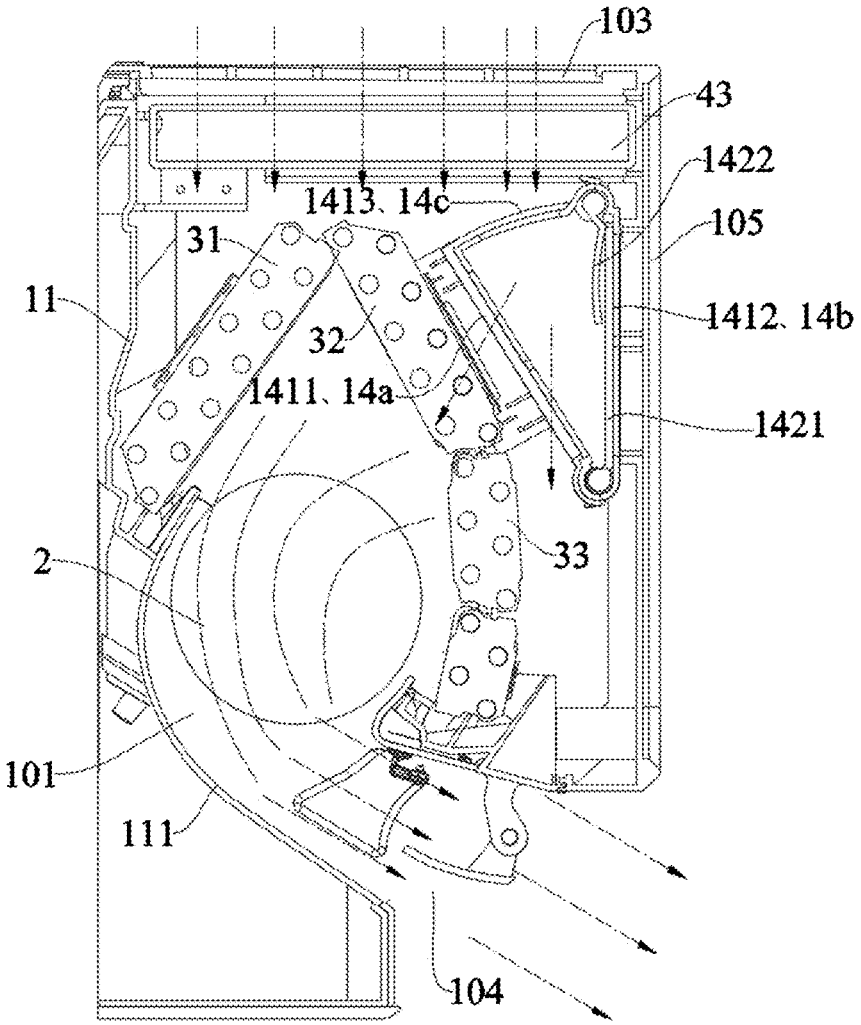
FIG. 7 is a schematic diagram of the structure shown in FIG. 6 in another state, in which a first air outlet and a first air inlet are open, a second air outlet is closed, an air supply mechanism is in a non-working state, and arrows and dotted lines indicate the flow path of the airflow.

In the third mode, referring to FIG. 7, the second air outlet 14*b* is closed, and the first air outlet 14*a* and the first air inlet 14*c* are both open. In this mode, the adapter air duct assembly 14 is in the second state, and the indoor return air from the first air intake port 103 enters the adapter air duct assembly 14 through the first air inlet 14*c* and flows to the evaporator 3 through the first air outlet 14*a*.

It should be noted that the second air inlet 14*d* can be kept normally open, or a switch door can be arranged at the second air inlet 14*d* to selectively open or close the second air inlet 14*d*. In an embodiment of the present disclosure, the second air inlet 14*d* is in a normally open state, which can simplify the structure and control.

When the adapter air duct assembly 14 is in the second state, in order to allow the adapter air duct assembly 14 to take in air from the first air intake port 103 easily, in the above-mentioned third mode, the air supply mechanism is in a non-working state. In other words, the air pressure in the second air duct is of atmospheric pressure, and the resistance of air taken in by the adapter air duct assembly 14 from the second air duct is greater than that from the first air intake port 103. For example, the wind resistance of the first purification module 41 and the wind resistance of the first filter screen module 42 are both greater than the air resistance of the second filter screen module 43. Under the negative pressure of the wind wheel 2, the adapter air duct assembly 14 will substantially take in air from the first air intake port 103, but basically not take in air from the second air duct.

Figure 8:
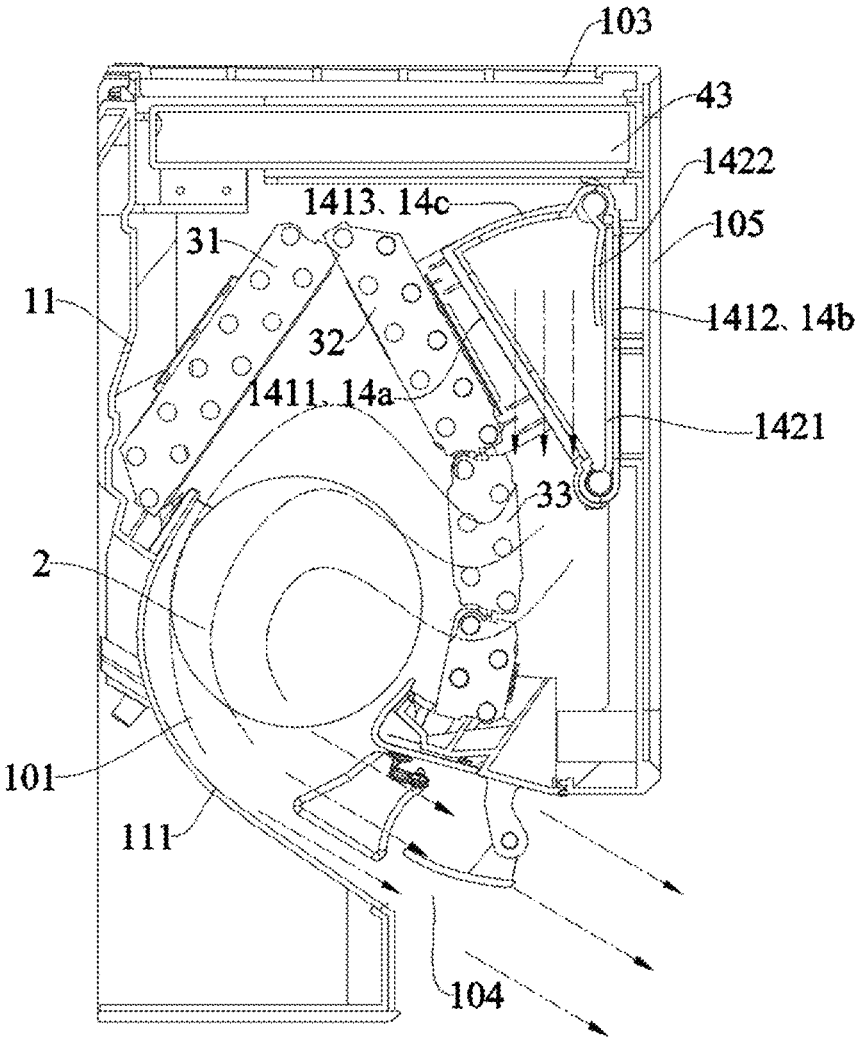
FIG. 8 is a schematic diagram showing that the air supply mechanism in the structure shown in FIG. 7 is in a working state, with arrows and dotted lines indicating the flow path of the airflow.

In some embodiments, the indoor unit has a fourth mode. Referring to FIG. 8, in the fourth mode, the second air outlet 14*b* is closed, the first air outlet 14*a* and the first air inlet 14*c* are both open. In other words, the adapter air duct assembly 14 is in the second state, the air supply mechanism is in the working state, and the resistance of air taken in by the adapter air duct assembly 14 from the second air duct is smaller than that from the first air intake port 103. It should be noted that when the air supply mechanism is in the working state, the air pressure in the second air duct located at an air outlet side of the air supply mechanism is positive, and the air supply mechanism sends the airflow in the second air duct into the adapter air duct assembly 14. Under the action of the wind wheel 2, the airflow entering the adapter air duct assembly 14 will not be discharged through the first air inlet 14*c*, but only through the first air outlet 14*a*.

In some embodiments, referring to FIGS. 5-8, the housing 1 includes a base plate 11, a face frame assembly 12 and a front panel. The base plate 11 and the face frame assembly 12 are in snap-fit connection to form an installation space. The base plate 11 is provided with a volute 111 in which the wind wheel 2 is rotatably arranged. The evaporator 3 is arranged at an air inlet side of the volute 111 in a covering manner. An air outlet end of the volute 111 is formed as the first air supply port 104. The base plate 11 is a structural stress-bearing part of the indoor unit. For example, the indoor unit is hung on a wall through the base plate 11, and the base plate 11 bears the weight of the components, such as, the face frame assembly 12, the front panel, the wind wheel 2, the air supply mechanism, an electric control box, etc.

The first air intake port 103 is arranged at a top side of the face frame assembly 12. The adapter air duct assembly 14 is arranged between a front side of the evaporator 3 and a rear side of the face frame assembly 12. In the second state, part of indoor return air from the first air intake port 103 passes through the adapter air duct assembly 14 from top to bottom. In this embodiment, the adapter air duct assembly 14 is arranged at the front side of the evaporator 3, which makes full use of the space at the front side of the evaporator 3, and allows the airflow of the second air duct to be easily guided to the evaporator 3 without changing the structural design of the first air duct 101.

In some embodiments, referring to FIGS. 5-8, the evaporator 3 includes a rear evaporator body 31, a middle evaporator body 32 and a front evaporator body 33 which are sequentially connected. Along the indoor unit from rear to front, the rear evaporator body 31 is arranged in an upward inclination manner, the middle evaporator body 32 is arranged in a downward inclination manner, and the front evaporator body 33 is connected to a bottom end of the middle evaporator body 32. The rear evaporator body 31, the middle evaporator body 32 and the front evaporator body 33 basically form an inverted V-shaped structure which covers the volute 111.

The adapter air duct assembly 14 abuts against a front side of the middle evaporator body 32. The indoor return air passing through the adapter air duct assembly 14 can flow to the middle evaporator body 32 and the front evaporator body 33. In other words, the adapter air duct assembly 14 does not affect the heat exchange efficiency of the middle evaporator body 32 and the front evaporator body 33 on the indoor return air. Because the middle evaporator body 32 is arranged in a downward inclination manner, the space between the middle evaporator body 32 and the face frame assembly 12 has a bigger upper part and a smaller lower part. The adapter air duct assembly 14 is wedged into the space between the middle evaporator body 32 and the face frame assembly 12. The middle evaporator body 32 can support the adapter air duct assembly 14. In other words, the weight of the adapter air duct assembly 14 can be borne by the middle evaporator body 32.

It can be understood that the adapter air duct assembly 14 can be connected to the face frame assembly 12, or the adapter air duct assembly 14 can be connected to the evaporator 3, or both the face frame assembly 12 and the evaporator 3 can be connected to the adapter air duct assembly 14.

Figure 4:
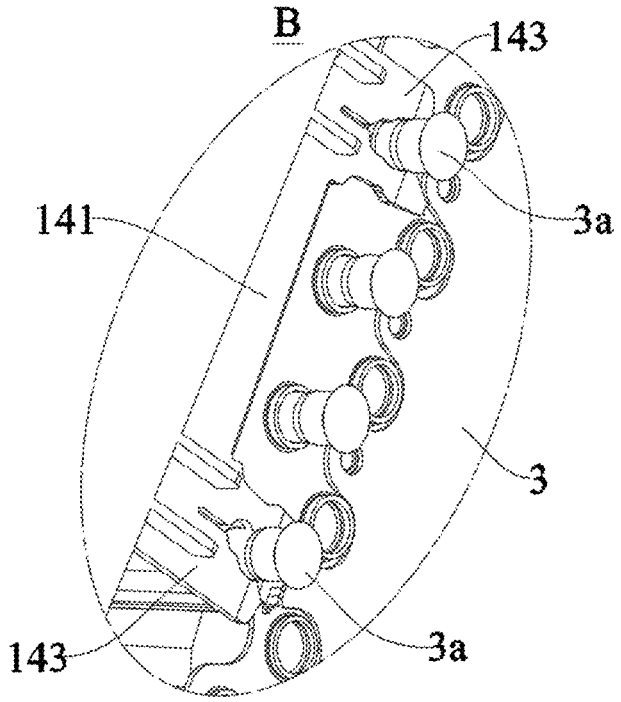
FIG. 4 is a partially enlarged view at B in FIG. 3.

For example, referring to FIG. 4, refrigerant pipe ends 3*a* are arranged at two opposite ends of the evaporator 3 in a length direction, and the adapter air duct assembly 14 is detachably connected to the refrigerant pipe ends 3*a*, such that the adapter air duct assembly 14 can be installed by using the existing structure of the evaporator 3.

Figure 10:
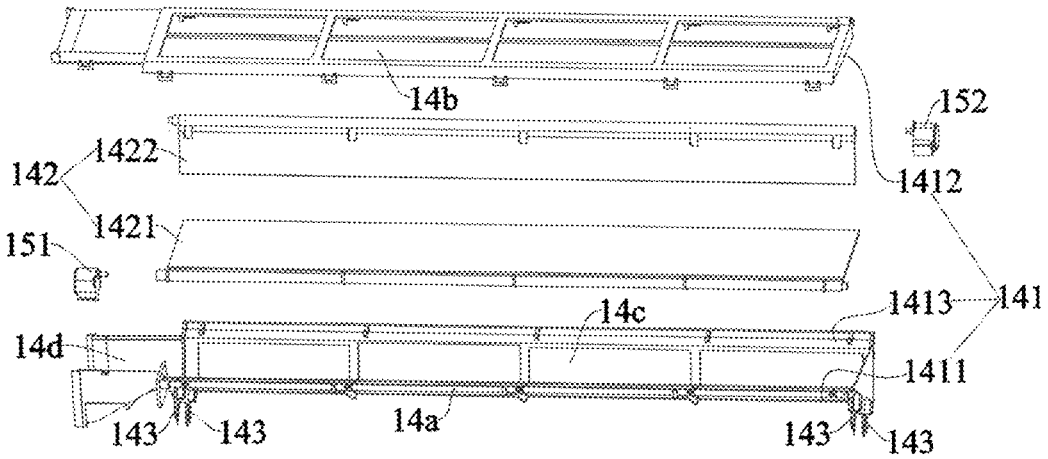
FIG. 10 is an exploded view of the structure shown in FIG. 9.

The mode of connection between the adapter air duct assembly 14 and the refrigerant pipe ends 3*a* is not limited, as long as installation and detachment are easy to implement. For example, referring to FIGS. 10-12, a side, facing the evaporator 3, of the adapter air duct assembly 14 is provided with an elastic snap fastener 143, the elastic snap fastener 143 is provided with a recess 143*a* and an opening 143*b*, and the opening 143*b* is restorably expanded by the refrigerant pipe end 3*a* when the refrigerant pipe end 3*a* fits into the recess 143*a*. During the assembling process, the recess 143*a* of the adapter air duct assembly 14 is aligned with the refrigerant pipe end 3*a* and connected to the refrigerant pipe end 3*a* in a snap-fit manner. In the process of fitting the refrigerant pipe end 3*a* into the recess 143*a*, the refrigerant pipe end 3*a* forces the elastic snap fastener 143 to elastically deform and expand the opening 143*b*. After the refrigerant pipe end 3*a* fits into the recess 143*a*, the elastic snap fastener 143 partially or completely recovers from the elastic deformation, and the opening 143*b* is narrowed to limit the refrigerant pipe end 3*a* in the recess 143*a*. The adapter air duct assembly 14 can be detached by pulling the adapter air duct assembly 14, such that, the elastic snap fastener 143 is disengaged from the refrigerant pipe end 3*a*.

The structure of the adapter air duct assembly 14 is not limited. For example, referring to FIG. 10, the adapter air duct assembly 14 includes an air duct body 141 and a valve assembly 142 movably arranged on the air duct body 141. The first air duct 101 and the second air duct are arranged in a length direction of the housing 1, and the air duct body 141 extends along the length direction of the housing 1. The size of the first air outlet 14*a* along the length direction of the housing 1 is roughly equivalent to the length of the evaporator 3, so as to increase the heat exchange area between the airflow from the adapter air duct assembly 14 and the evaporator 3 and improve the heat exchange efficiency. Thus, the space at the front side of the evaporator 3 can be made of full use.

Figure 11:
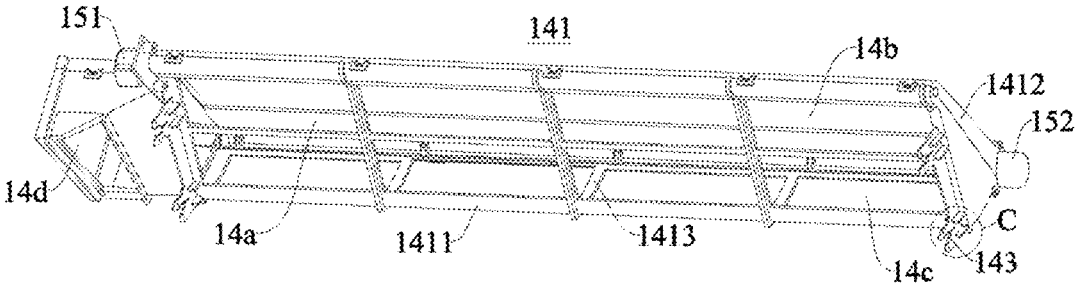
FIG. 11 is a schematic diagram of the structure shown in FIG. 9 from another perspective, in which a valve assembly is omitted.
Figure 12:
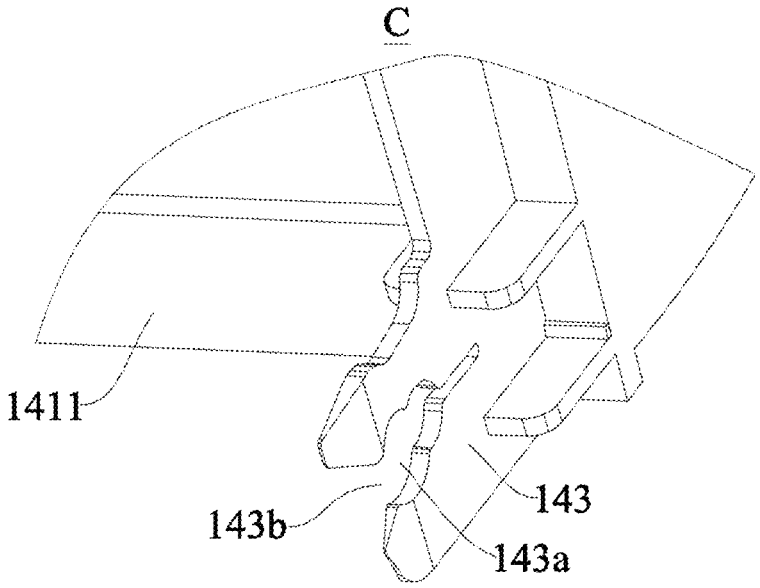
FIG. 12 is a partially enlarged view at C in FIG. 11.

Referring to FIG. 11, a rear side of the air duct body 141 is provided with the first air outlet 14*a*, a top side of the air duct body 141 is provided with the first air inlet 14*c*, and a front side of the air duct body 141 is provided with the second air outlet 14*b*. The second air outlet 14*b* is aligned with the second air supply port 105 to discharge air. The valve assembly 142 can move relative to the air duct body 141 to selectively close the first air inlet 14*c*, the first air outlet 14*a* or the second air outlet 14*b*. In this embodiment, the air duct body 141 remains stationary, and the direction of airflow is switched by the movement of the valve assembly 142.

The structure of the air duct body 141 is not limited. In some embodiments, referring to FIGS. 10 and 11, the air duct body 141 includes a top frame plate 1413, a first frame plate 1411 abutting against the evaporator 3, and a second frame plate 1412 arranged at a front side of the first frame plate 1411. A lower end of the first frame plate 1411 is connected to a lower end of the second frame plate 1412. The first frame plate 1411, the second frame plate 1412 and the top frame plate 1413 basically form a triangular structure. In this embodiment, a gap on the first frame plate 1411 forms the first air outlet 14*a*, a gap on the second frame plate 1412 forms the second air outlet 14*b*, and a gap on the top frame plate 1413 forms the first air inlet 14*c*.

The valve assembly 142 includes a first valve plate 1421 and a second valve plate 1422. A lower end of the first valve plate 1421 is rotatably connected to a joint between the first frame plate 1411 and the second frame plate 1412. The first valve plate 1421 can be selectively arranged on an inner surface of the first frame plate 1411 or an inner surface of the second frame plate 1412 in an overlaying manner. In other words, the opening and closing of the first air outlet 14*a* and the second air outlet 14*b* can be controlled by the first valve plate 1421. Therefore, only one of the first air outlet 14*a* and the second air outlet 14*b* is closed at the same moment, and the two of them will not be closed at the same time. The second valve plate 1422 is arranged at the first air inlet 14*c* to selectively open or close the first air inlet 14*c*.

In some embodiments, a front end of the second valve plate 1422 is rotatably connected to the air duct body 141. Referring to FIGS. 7 and 8, the second valve plate 1422 can rotate to abut against an inner surface of the second frame plate 1412 and open the first air inlet 14*c*. In this embodiment, when the second valve plate 1422 opens the first air inlet 14*c*, the second valve plate 1422 basically does not affect the flow area of the first air inlet 14*c* or the first air outlet 14*a*, and the indoor return air from the first air intake port 103 can pass through the top frame plate 1413 and the first frame plate 1411 more smoothly.

It should be noted that the first frame plate 1411, the second frame plate 1412 and the top frame plate 1413 can be provided separately and subsequently assembled together, for example, in a snap-fit manner. Alternatively, any two of them can be integrally formed, such as through integral injection molding.

Figure 9:
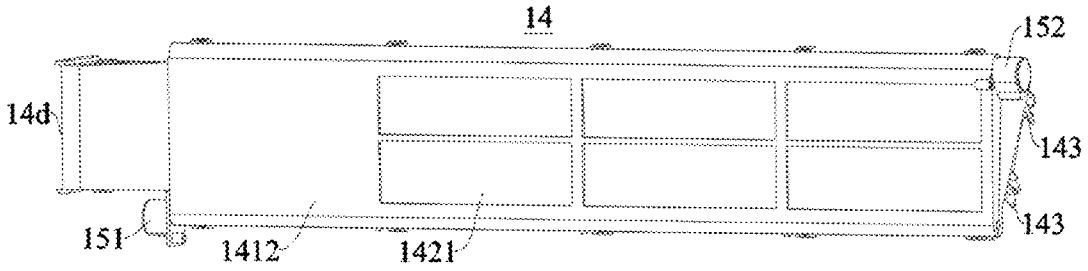
FIG. 9 is a schematic diagram of an adapter air duct assembly according to an embodiment of the present disclosure.

The driving mode of the first valve plate 1421 is not limited. For example, referring to FIGS. 9-11, the indoor unit includes a first motor 151, and a motor shaft of the first motor 151 is rotatably connected to the first valve plate 1421.

The driving mode of the second valve plate 1422 is not limited. For example, referring to FIGS. 9-11, the indoor unit includes a second motor 152, and a motor shaft of the second motor 152 is rotatably connected to the second valve plate 1422.

In the embodiment with the first motor 151 and the second motor 152, the first motor 151 and the second motor 152 can be arranged at two opposite ends of the air duct body 141 in the length direction to prevent interference between the first motor 151 and the second motor 152.

An embodiment of the present disclosure provides an air conditioner including an outdoor unit and the indoor unit according to any one of the above embodiments, and the outdoor unit and the indoor unit are connected through a refrigerant pipe.

The various embodiments/implementations provided in the present disclosure may be combined with each other without conflict.

The above is only the description of some exemplary embodiments of the present disclosure, and is not intended to limit the present disclosure. It will be apparent to those having ordinary skill in the art that various modifications and variations can be made to the present disclosure. Any modifications, equivalent substitutions, improvements, etc. made within the scope and principle of the present disclosure shall fall within the scope of protection of the present disclosure.

What is claimed is:

1. An indoor unit of an air conditioner, comprising:

a housing comprising a first air duct, a second air duct, a first air intake port, a first air supply port, a second air intake port and an adapter air duct assembly, the first air duct communicating with the first air intake port and the first air supply port, and the second air duct communicating with the second air intake port and the adapter air duct assembly; and an evaporator arranged in the first air duct, the adapter air duct assembly being arranged in the first air duct and located at an air inlet side of the evaporator, wherein:

the adapter air duct assembly has a first state and a second state;

in the first state, the adapter air duct assembly takes in air from the second air duct and guides an airflow of the second air duct to a preset air outlet position;

in the second state, a part of indoor return air from the first air intake port passes through the adapter air duct assembly;

a side, facing the evaporator, of the adapter air duct assembly is provided with a first air outlet, and an airflow in the adapter air duct assembly is dischargeable from the first air outlet and flows to the evaporator;

the housing is provided with a second air supply port, the adapter air duct assembly is provided with a second air outlet communicating with the second air supply port; and in the first state, the adapter air duct assembly selectively discharges the airflow from the second air duct through the first air outlet or the second air outlet;

a side, proximate to the first air intake port, of the adapter air duct assembly is provided with a first air inlet, and the first air inlet and the first air outlet are located on a flow path of the indoor return air from the first air intake port;

the indoor unit has a first mode, a second mode and a third mode;

in the first mode, the first air outlet is open, the second air outlet and the first air inlet are both closed, and the airflow from the second air duct flows to the evaporator through the first air outlet and is output through the first air supply port;

in the second mode, the second air outlet is open, the first air outlet and the first air inlet are both closed, and the airflow from the second air duct flows to the second air supply port through the second air outlet and is output through the second air supply port; and in the third mode, the second air outlet is closed, the first air outlet and the first air inlet are both open, and the indoor return air from the first air intake port enters the adapter air duct assembly through the first air inlet through the first air outlet.

2. The indoor unit of claim 1, wherein in the third mode, a resistance of air taken in by the adapter air duct assembly from the second air duct is greater than that from the first air intake port.

3. The indoor unit of claim 1, wherein:

the indoor unit has a fourth mode; and in the fourth mode, the second air outlet is closed, the first air outlet and the first air inlet are both open, and a resistance of air taken in by the adapter air duct assembly from the second air duct is smaller than that from the first air intake port.

4. The indoor unit of claim 1, wherein:

the adapter air duct assembly comprises an air duct body and a valve assembly movably arranged on the air duct body, the first air duct and the second air duct are arranged along a length direction of the housing, and the air duct body extends along the length direction of the housing;

a rear side of the air duct body is provided with the first air outlet, a top side of the air duct body is provided with the first air inlet, a front side of the air duct body is provided with a second air outlet, and the second air outlet is aligned with the second air supply port to discharge air; and the valve assembly is movable relative to the air duct body to selectively close the first air inlet, the first air outlet or the second air outlet.

5. The indoor unit of claim 4, wherein:

the air duct body comprises a top frame plate, a first frame plate abutting against the evaporator, and a second frame plate arranged at a front side of the first frame plate, and a lower end of the first frame plate is connected to a lower end of the second frame plate; and the valve assembly comprises a first valve plate and a second valve plate, a lower end of the first valve plate is rotatably connected at a joint between the first frame plate and the second frame plate, the first valve plate is selectively arrangeable on an inner surface of the first frame plate or an inner surface of the second frame plate in an overlaying manner, and the second valve plate is arranged at the first air inlet to selectively open or close the first air inlet.

6. The indoor unit of claim 5, wherein a front end of the second valve plate is rotatably connected to the air duct body, and the second valve plate is rotatable to abut against the inner surface of the second frame plate and open the first air inlet.

7. The indoor unit of claim 1, wherein:

the second air intake port is a fresh air inlet; or the second air intake port is an indoor purification air return port.

8. The indoor unit of claim 1, wherein:

a plurality of second air intake ports is arranged in the housing, at least one of the second air intake ports is a fresh air inlet, and at least one of remaining second air intake ports is an indoor purification air return port; and the second air duct selectively takes in air from the fresh air inlet.

9. The indoor unit of claim 1, wherein:

a plurality of second air intake ports is arranged in the housing, at least one of the second air intake ports is a fresh air inlet, and at least one of remaining second air intake ports is an indoor purification air return port; and the second air duct selectively takes in air from the indoor purification air return port.

10. The indoor unit of claim 1, wherein:

the housing comprises a base plate, a face frame assembly, and the base plate and the face frame assembly are in snap-fit connection;

the first air intake port is arranged at a top side of the face frame assembly, and the adapter air duct assembly is arranged between a front side of the evaporator and a rear side of the face frame assembly; and in the second state, part of the indoor return air from the first air intake port passes through the adapter air duct assembly from top to bottom of the adapter air duct assembly.

11. The indoor unit of claim 10, wherein:

the evaporator comprises a rear evaporator body, a middle evaporator body and a front evaporator body which are sequentially connected, and the middle evaporator body is arranged along the indoor unit from rear to front of the indoor unit in a downward inclination manner; and the adapter air duct assembly abuts against a front side of the middle evaporator body, and indoor return air passing through the adapter air duct assembly flows to the middle evaporator body and the front evaporator body.

12. The indoor unit of claim 10, wherein t one end of the evaporator in a length direction is provided with a refrigerant pipe end, and the adapter air duct assembly is detachably connected to the refrigerant pipe ends.

13. The indoor unit of claim 12, wherein:

a side, facing the evaporator, of the adapter air duct assembly is provided with an elastic snap fastener, the elastic snap fastener is provided with a recess and an opening which communicate with each other, and the opening is restorably expanded by one of the refrigerant pipe ends when the one of the refrigerant pipe ends fits into the recess.

14. The air conditioner comprising an outdoor unit and the indoor unit of claim 1, wherein the outdoor unit and the indoor unit are connected through a refrigerant pipe.

* * * * *